US009408468B2

(12) United States Patent
Goodman

(10) Patent No.: US 9,408,468 B2
(45) Date of Patent: Aug. 9, 2016

(54) FURNITURE WITH CONCEALED WELD CONSTRUCTION

(71) Applicant: Lee L. Goodman, Miami, FL (US)

(72) Inventor: Lee L. Goodman, Miami, FL (US)

(73) Assignee: Pavilion Furniture, Miami, FL (US)

( * ) Notice: Subject to any disclaimer, the term of this patent is extended or adjusted under 35 U.S.C. 154(b) by 49 days.

(21) Appl. No.: 14/460,448

(22) Filed: Aug. 15, 2014

(65) Prior Publication Data

US 2016/0045028 A1 Feb. 18, 2016

(51) Int. Cl.

| | |
|---|---|
| ***A47C 5/04*** | (2006.01) |
| ***A47C 3/00*** | (2006.01) |
| ***A47C 3/16*** | (2006.01) |
| ***A47C 3/18*** | (2006.01) |

(52) U.S. Cl.

CPC ... *A47C 3/00* (2013.01); *A47C 3/16* (2013.01); *A47C 3/18* (2013.01); *A47C 5/04* (2013.01)

(58) Field of Classification Search

CPC ..... Y10T 403/4602; Y10T 403/4694; A47C 5/04

USPC ..... 297/452.18, 452.14, 452.12, 452.11, 297/344.21; 52/481.1, 481.2, 710; 403/387, 403/187

See application file for complete search history.

(56) References Cited

U.S. PATENT DOCUMENTS

| | | | | | |
|---|---|---|---|---|---|
| 2,401,542 | A | | 6/1946 | Booth | |
| 2,649,147 | A | | 8/1953 | Sanford | |
| 2,671,631 | A | | 3/1954 | Martin | |
| 2,876,051 | A | | 3/1959 | Martin | |
| 3,698,150 | A | * | 10/1972 | Anderson | A47B 91/00 249/188 |
| 3,873,155 | A | * | 3/1975 | Barecki | A47C 4/02 297/440.2 |
| 3,989,212 | A | * | 11/1976 | Jennings | A47C 3/04 16/42 T |
| 4,036,527 | A | * | 7/1977 | Faul | B60N 2/242 297/232 |
| 4,123,105 | A | * | 10/1978 | Frey | A47C 5/12 297/451.1 |
| 4,131,314 | A | | 12/1978 | Knapp et al. | |
| 4,824,170 | A | | 4/1989 | Goldmeier | |
| 4,962,964 | A | | 10/1990 | Snodgrass | |
| 5,044,694 | A | * | 9/1991 | Koa | B60N 2/40 297/452.12 |
| 5,203,639 | A | * | 4/1993 | Femrite | F16B 12/04 403/340 |
| 5,456,531 | A | * | 10/1995 | Beals | A47B 55/00 312/330.1 |
| 5,690,388 | A | | 11/1997 | Saiger | |
| 5,704,509 | A | * | 1/1998 | Rosenkrantz | B65D 88/34 220/216 |
| 5,746,476 | A | * | 5/1998 | Novak | B60N 2/242 297/216.13 |

(Continued)

*Primary Examiner* — Timothy J Brindley

(74) *Attorney, Agent, or Firm* — Mayback & Hoffman, P.A.; Gregory L Mayback

(57) ABSTRACT

Furniture having a panel welded to frame elements whereby the welding is not visible from the exterior. The panel may have decorative features created by stamping, cutting, punching, or perforating. The construction methodology is useful for chairs, barstools, loungers, and ottomans as well as a variety of other furniture.

14 Claims, 8 Drawing Sheets

(56) References Cited

U.S. PATENT DOCUMENTS 5,749,135 A 5/1998 Crane et al.
5,816,649 A 10/1998 Shields
5,988,756 A * 11/1999 Aufrere ..... B60N 2/68 297/391
6,092,346 A * 7/2000 Even ..... E02D 5/06 403/363
6,095,603 A * 8/2000 Hock ..... A47C 1/12 297/232
6,779,849 B1 * 8/2004 Harper ..... A47C 5/06 297/440.11
7,635,165 B2 * 12/2009 Robert ..... B60N 2/682 297/452.18
8,398,141 B2 * 3/2013 Parker ..... B60N 2/0705 296/64
8,814,273 B2 * 8/2014 Zekavica ..... 297/378.1
2004/0011927 A1 * 1/2004 Christman ..... B29C 65/00 244/131
2004/0113481 A1 * 6/2004 Saberan ..... B60N 2/682 297/452.18
2006/0096224 A1 * 5/2006 Asbury ..... F16B 5/02 52/582.1
2009/0014044 A1 * 1/2009 Hartman ..... E04B 1/3445 135/143
2009/0184562 A1 * 7/2009 Wilson ..... B60N 2/242 297/452.18
2010/0244538 A1 * 9/2010 Gross ..... B60N 2/682 297/452.18
2010/0320826 A1 * 12/2010 Wilson ..... B60N 2/682 297/452.18
2015/0033648 A1 * 2/2015 Hobeyn ..... E04B 2/7435 52/241

* cited by examiner

FURNITURE WITH CONCEALED WELD CONSTRUCTION

Figure 1:
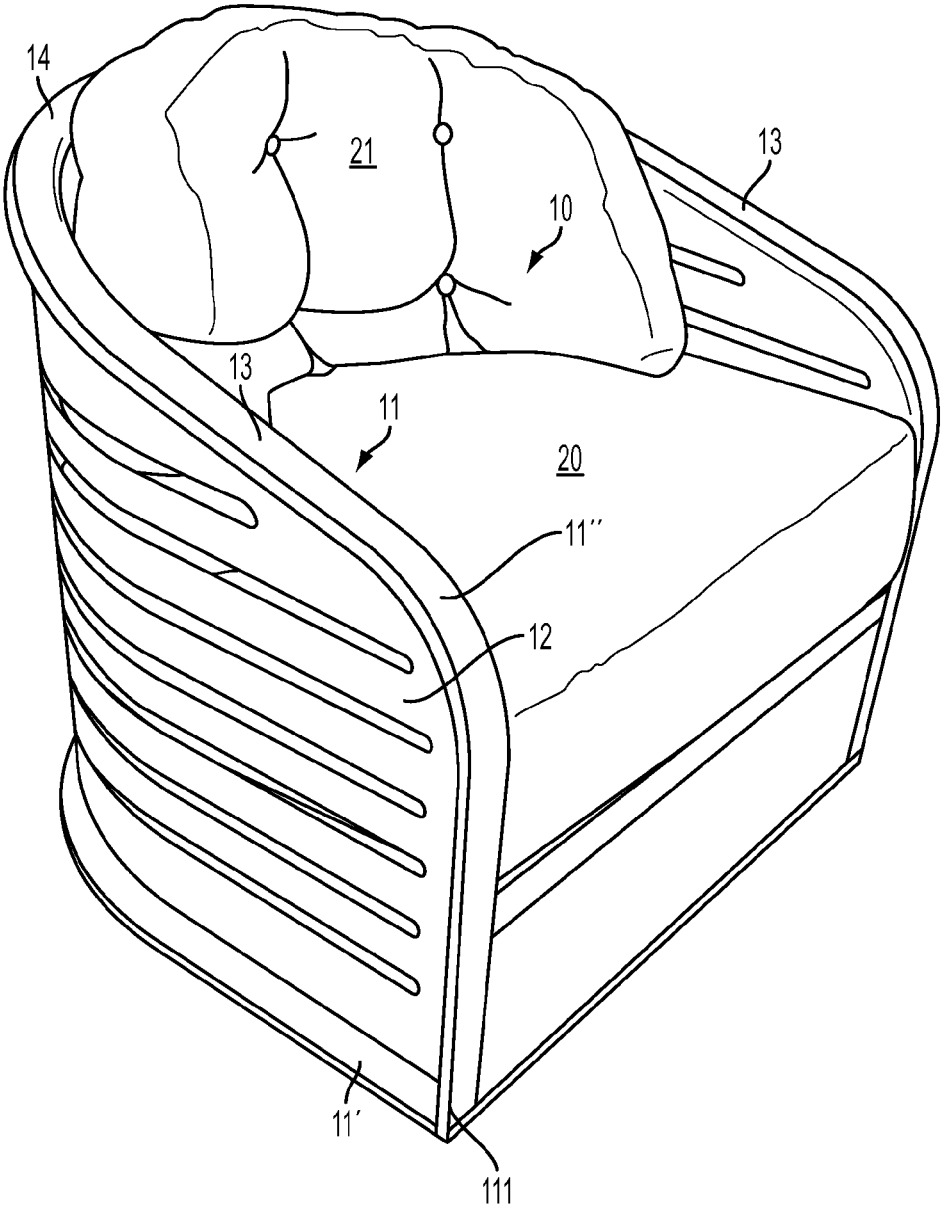
FIG. 1 is a perspective view of a swivel chair including concealed weld construction.

Various embodiments of furniture having common construction techniques are disclosed herein. Referring to FIG. 1, chair 10 comprises a frame 11 and a seatback panel 12. In some embodiments, the frame 11 comprises a plurality of elements such as, for example, base frame element 11' and upper frame element 11". In FIG. 1, the base frame element 11" is generally U-shaped delimiting a seat 15. The upper frame element 11" extends upward from the front edges 111 of the base frame element 11' and then curves upward and around to define armrests 13 and top rail 14. Seat 15 is disposed between adjacent portions of the upper frame element 11" at an elevation above the base frame elements 11". Seatback panel 12 is disposed inside frame 11 between base frame element 11' and upper frame element 11" and is attached thereto to form the side and rear supporting portions of the chair 10. In some embodiments, the seatback panel 12 is perforated, punched, cut, or stamped with any desired design. Cutting may be accomplished by a CNC machine, waterjet, laser cutter or other known precision cutting means. Shown also is seat cushion 20 disposed on seat frame 15 and back cushion 21 disposed against an interior aspect of the seatback panel 12.

Figure 2A:
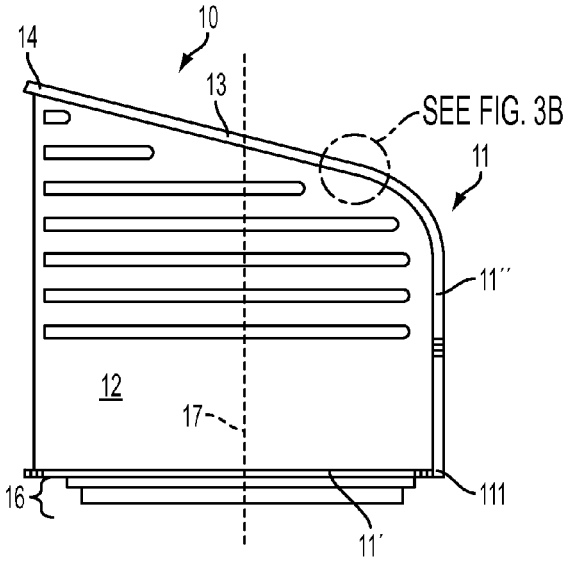
FIG. 2A is a side elevation view of the swivel chair shown in FIG. 1
Figure 2B:
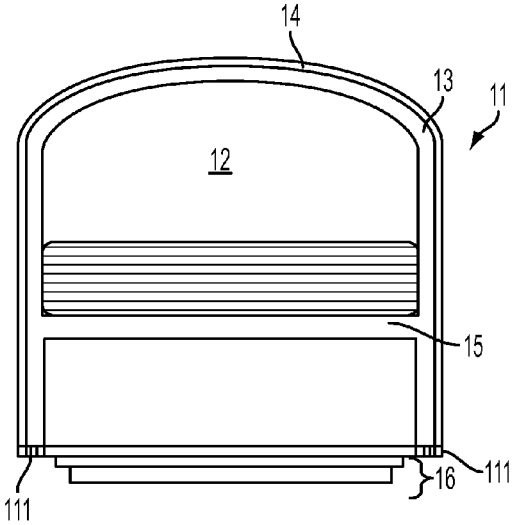
FIG. 2B is a front elevation view of the swivel chair shown in FIG. 1
Figure 2C:
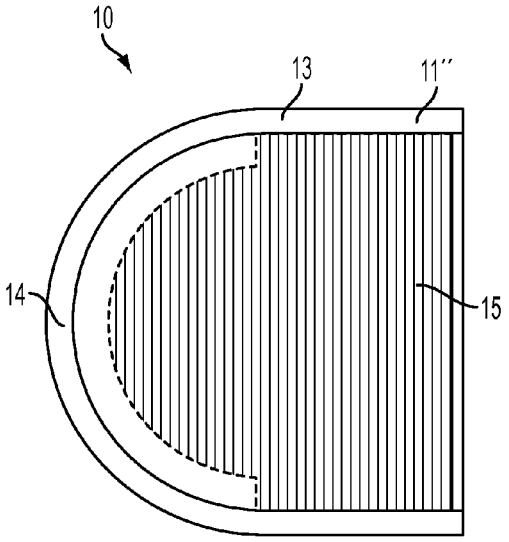
FIG. 2C is a top elevation view of the swivel chair shown in FIG. 1.

FIGS. 2A-2C show various views of the chair 10. Referring to the side view in FIG. 2A, the orientation and configuration of frame 11 is shown in more detail. Here it is seen that the base frame element 11' is generally oriented on a single plane whereas the upper frame element 11" extends in curvilinear fashion from the base frame element 11'. Also shown is swivel base 16 on which chair 10 is mounted. Swivel base 16 is generally configured as a ball-bearing or similar rotating mount that allows chair 10 to at least partially swivel or rotate about its central axis 17. Referring to the front view in FIG. 2B, shown in more detail is seat frame 15 that extends horizontally across frame 11 to provide vertical support for an individual using the chair 10. Referring to the top view in FIG. 2C, shown in more detail is the upper frame element 11" which in a plain view has a U-shaped profile matching that of bottom frame element 11'. Here it is more easily seen how upper frame element 11" is shaped to form the opposing armrests 13 and top rail 14 from a single, contiguous frame member.

Figure 3A:
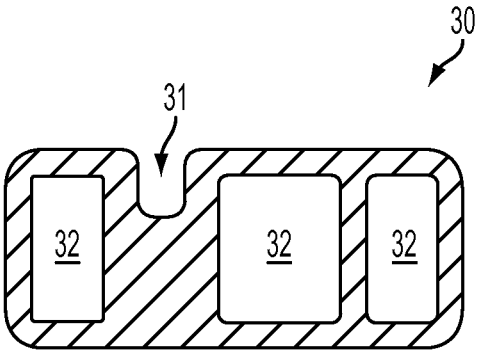
FIG. 3A is a cross-sectional view of a frame extrusion.
Figure 3B:
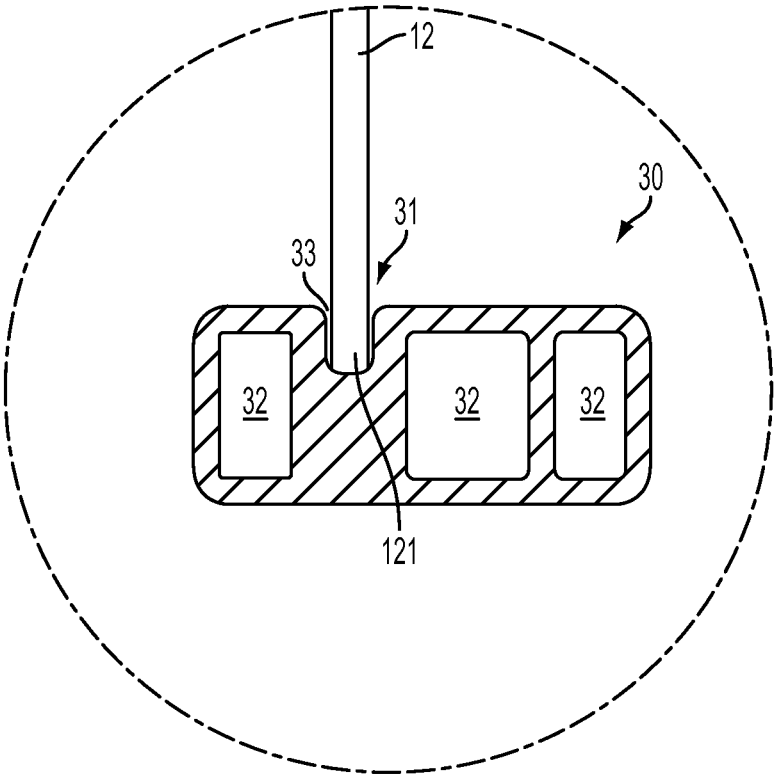
FIG. 3B is an enlarged view of the engagement of a furniture panel with the extrusion.

Referring to FIGS. 3A and 3B, the frame 11 of chair 10 comprises an extrusion 30 having certain features advantageous to the construction of the furniture items disclosed herein. In some embodiments, extrusion 30 has a generally rectangular cross-section with rounded or beveled edges. In some embodiments, extrusion 30 includes a longitudinally oriented insertion channel 31 that is configured to receive the panel 12 as shown in FIG. 3B and further described herein. In some embodiments, extrusion 30 may have one or more longitudinally oriented relief channels 32 provided therethrough that reduce the weight and increase the bendability of extrusion 30 to allow for the design of a multitude of furniture configurations in accordance with the present disclosure. Referring to FIG. 3B, chair 10 is assembled by inserting at least a portion of the perimeter edge 121 of the seatback panel 12 into the insertion channel 31 of extrusion 30. In some embodiments, the entire perimeter edge of the seatback panel 12 is seated in the insertion channel, such that the frame 11 encircles the perimeter of the panel.

In some examples, the thickness of the panel 12 is somewhat smaller than the width of insertion channel 31, resulting in a small gap 33 that provides sufficient space for the application of a weld on an interior aspect of, i.e. inside, insertion channel 31 to secure panel 12 to extrusion 30. In some embodiments, the gap 33 allows the weld to be at least partially concealed from view and, in some embodiments, the welds are disposed within the gap 33 such that the welds are not visible from an exterior aspect of chair 10, i.e. when viewed from the outside, resulting in an unobstructed and smooth finish to the chair 10. In some embodiments, welds can be placed only on one side of the panel 12, for example on the interior side, such that there are no welds at all on the exterior side of the panel 12 with respect to the extrusion 30, providing a clean unobstructed view from the exterior of the chair 10.

Figure 4A:
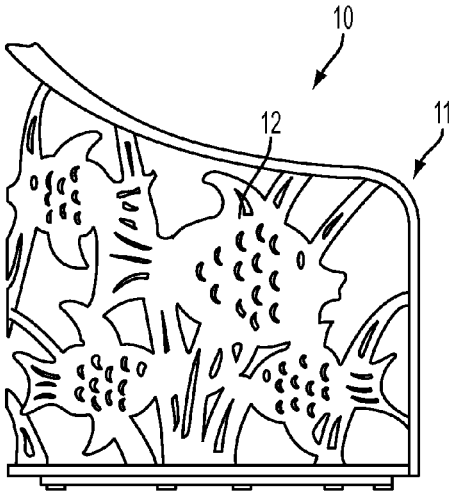
FIGS. 4A-4D show various embodiments of the swivel chair shown in FIG. 1.
Figure 4B:
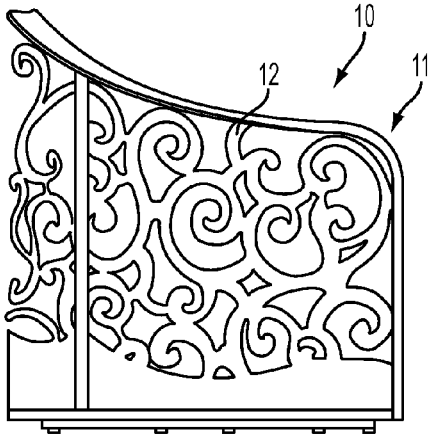
Figure 4C:
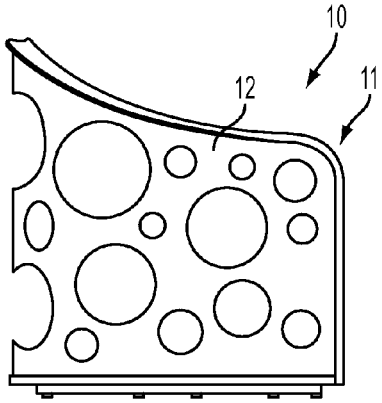
Figure 4D:
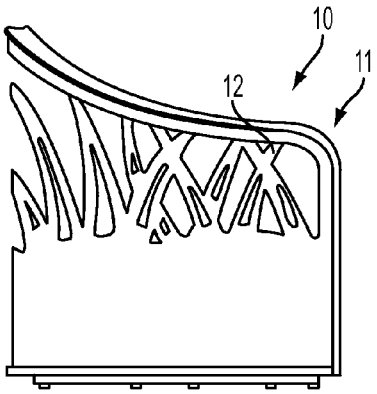

FIGS. 4A through 4D depict various embodiments of the chair 10 having seatback panels 12 of various designs and embellishment assembled in accordance with the present disclosure. Accordingly, it is appreciated and understood that the seatback panel 12 can be manufactured through a variety of means such as stamping, punching, die cutting, and the like, to provide a multitude of designs and features as desired. For exemplary purposes only, chair 10 in FIG. 4A shows a seatback panel 12 having fish designs, chair 10 in FIG. 4B has a filigree design, chair 10 in FIG. 4C has a punched circle design, and chair 10 in FIG. 4D has a grass design.

Figure 5A:
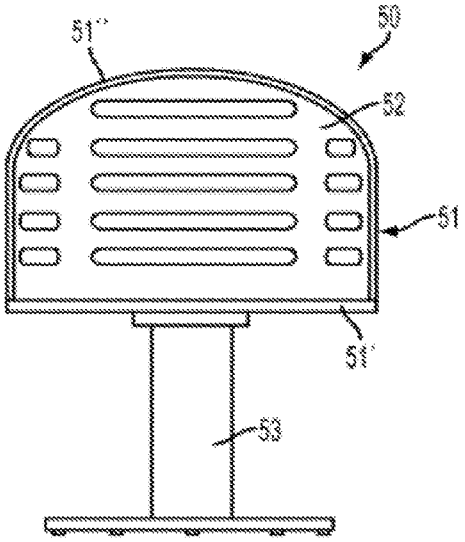
FIG. 5A is a rear elevation view of an armchair including concealed weld construction.
Figure 5B:
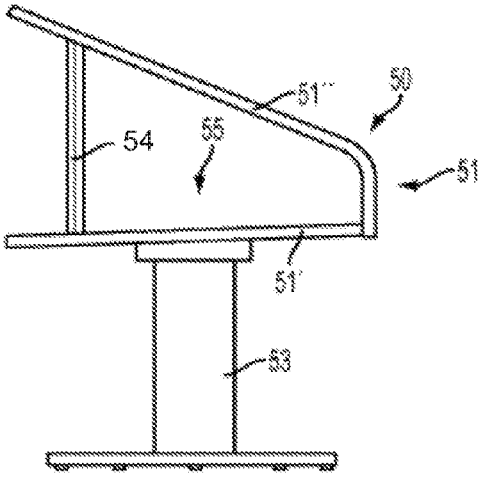
FIG. 5B is a side elevation view of the armchair shown in FIG. 5A.
Figure 5C:
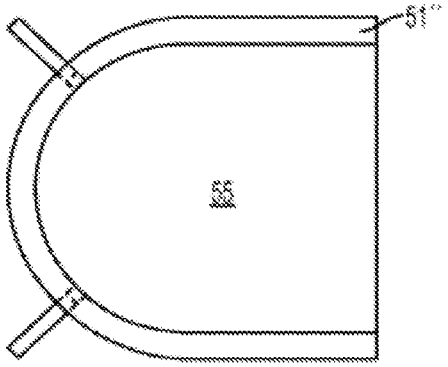
FIG. 5C is a top elevation view of the armchair shown in FIG. 5A.

Referring to FIG. 5, shown is dining armchair 50 assembled in accordance with the present disclosure. Armchair 50 comprises a frame 51 and a back panel 52. Frame 51 is constructed from extrusion 30 and comprises base frame element 51' and upper frame element 51". Base frame element 51' is, in some embodiments, generally U-shaped and delimits the seat 55 for the barstool 50. Upper frame element 51" extends upward from the base frame element 51' and is curved to form the armrests and top rail of the armchair 50. In some embodiments, as shown in FIG. 5B (back panel 52 omitted for clarity), a vertically oriented seatback 54 is disposed between the upper frame element 51" and seat 55. In such embodiments, the user rests against seatback 54 instead of back panel 52 (which otherwise surrounds the armchair 50), which may be somewhat more comfortable for the user depending on the overall shape and dimension of the armchair 50. Here, the bottom of seat 55 is mounted to a pedestal 53. In some embodiments, armchair 50 swivels or rotates about pedestal 53. Back panel 52 is configured to be inserted into frame 51 in accordance with the above description of the extrusion 30 wherein the welds attaching same are at least partially concealed inside the insertion channel 31 of extrusion 30. In some embodiments, the welds are entirely concealed.

Figure 6A:
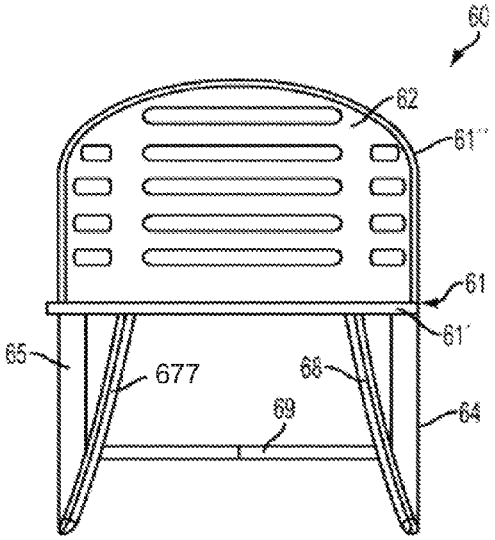
FIG. 6A is a rear elevation view of another armchair including concealed weld construction.
Figure 6B:
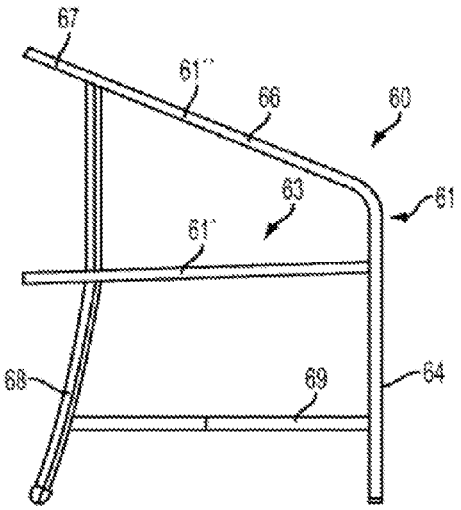
FIG. 6B is a side elevation view of the armchair shown in FIG. 6A.
Figure 6C:
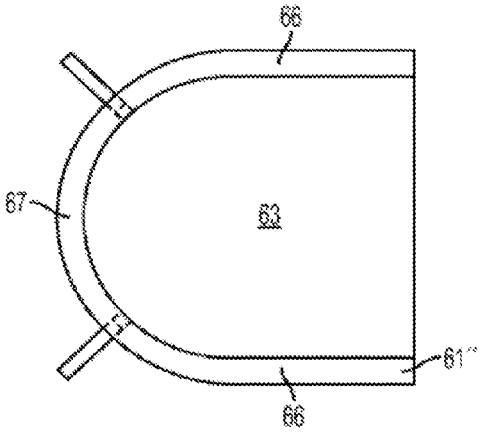
FIG. 6C is a top elevation view of the armchair shown in FIG. 6A.

Referring to FIGS. 6A-6C shown is an alternative armchair 60 assembled with a traditional four-legged bottom. Here armchair 60 comprises a frame 61 and a back panel 62. Frame 61 is constructed from extrusion 30 and comprises a base frame element 61' that is generally U-shaped and that delimits the seat 63. Upper frame element 61" is attached at the front of base frame element 61' and forms the front two legs 64 and 65 of the armchair 60. Upper frame element 61" continues upward to define the armrests 66 and top rail 67 of the armchair 60. Back panel 62 is configured to be inserted into frame 62 in accordance with the above description of the extrusion 30 wherein the welds attaching same are at least partially concealed inside the insertion channel 31 of extrusion 30. In some embodiments, the welds are entirely concealed. Rear legs 677 and 68 extend from the base frame element 61' to form the bottom supporting structure for the armchair 60. In some embodiments, one or more stretchers 69 are attached to adjacent legs to provide additional rigidity.

Figure 7A:
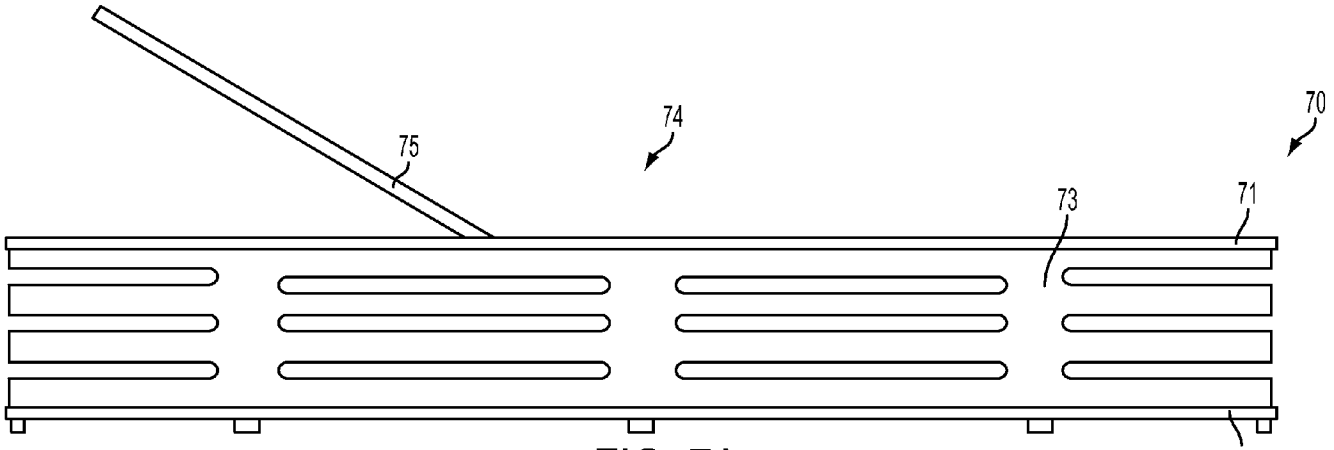
FIG. 7A is a side view of a lounger including concealed weld construction.
Figure 7B:
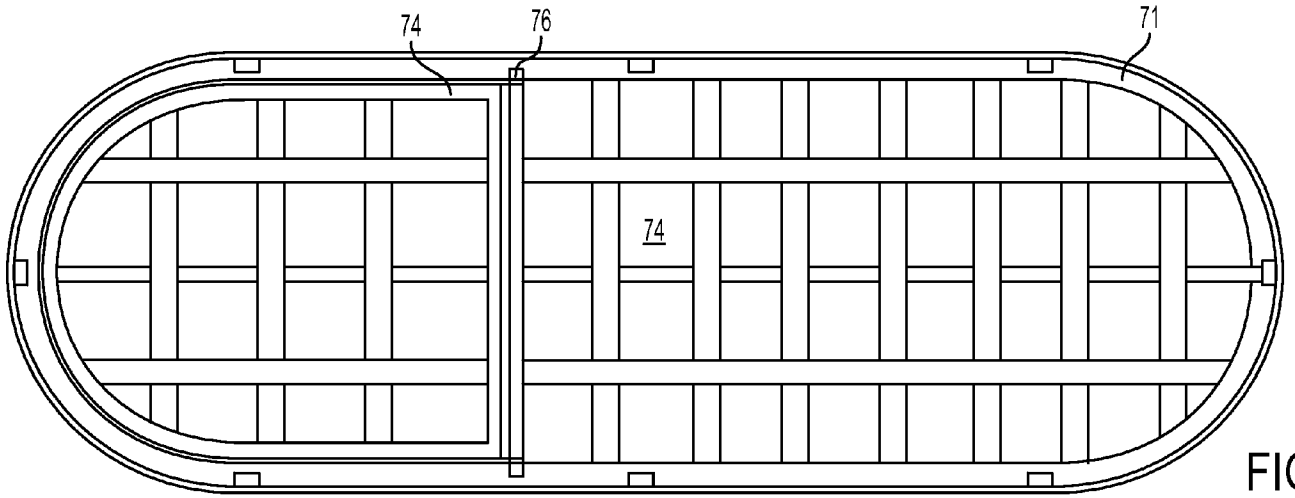
FIG. 7B is a top view of the lounger in FIG. 7A.

Referring to FIGS. 7A and 7B, shown is lounger 70 comprising an upper frame 71, a lower frame 72, and a circumferential panel 73. Panel 73 is disposed between the upper frame 71 and lower frame 72 to form an outer encasement of the lounger. The upper frame 71 delimits an upper lounging surface 74. Further included in some embodiments is an adjustable seatback 75 attached to lounger 70 at pivot point 76. In some embodiments, the lounging surface 74 comprises a grid-like structure that is adapted to spread out the weight of a load placed thereon, 5 such as by an individual laying or sitting on the lounger 70. Upper and lower frame 71 and 72 are comprised of extrusion 30 and panel 73 is attached thereto in the manner shown in FIG. 3B, namely by inserting the perimeter edges of the panel 73 into the insertion channel 31 of the extrusion 30 and welding the components at an interior aspect of the insertion channel 31. This allows the welds to be at least partially concealed and, in some embodiments, to be entirely concealed.

Figure 8A:
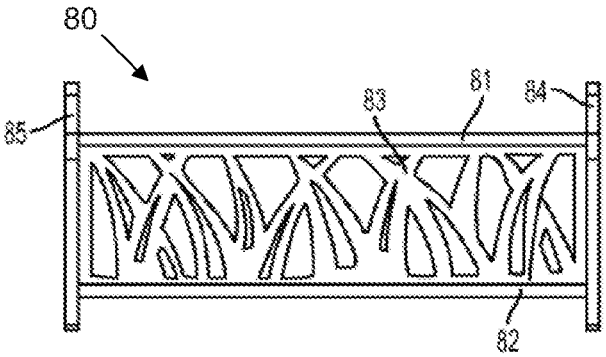
FIG. 8A is a side view of an ottoman including concealed weld construction.
Figure 8B:
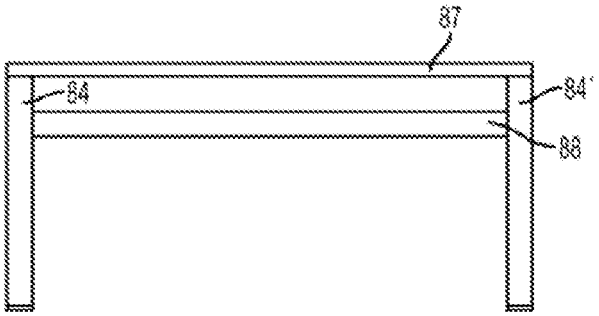
FIG. 8B is front view of the ottoman in FIG. 8A.
Figure 8C:
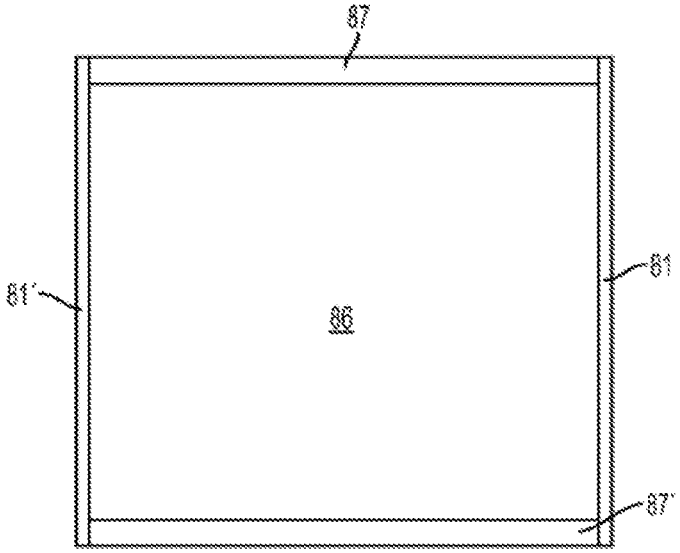
FIG. 8C is a top view of the ottoman in FIG. 8A.

Referring to FIGS. 8A-8C shown is ottoman 80. Side view 8A shows ottoman 80 comprising upper frame element 81, lower frame element 82, and side panel 83. Side supports 84 and 85 are perpendicular to upper frame 81 and lower frame 82. Upper frame 81 and side supports 84 and 85 delimit a resting surface 86 for the ottoman 80. FIG. 8B is an end view showing top rail 87 and stretcher 88 disposed between respective side supports 84 and 84" wherein side support 84" is parallel to side support 84. Shown in top view 8C are opposing top rails 87 and 87' as well as opposing upper frame elements 81 and 81'. Side panel 83 is disposed between upper frame element 81 and lower frame element 82. The frame elements 81 and 82 are comprised of extrusion 30 and receive the edges of side panel 83 substantially as described above and shown in FIG. 3B. In some embodiments, side panel 83 is provided on both sides of ottoman 80 between respective upper and lower frame elements.

It is appreciated and understood that the present disclosure contemplates a multitude of furniture designs and configurations including without limitation chairs, tables, loungers, ottomans, and barstools, each incorporating one or more frame elements comprising extrusion 30 and at least one panel configured to be received by extrusion 30 and welded thereto in a concealed fashion. To that end, extrusion 30 may comprise any suitable material including metals such as steel and aluminum provided such material is sufficiently strong and bendable for the desired application. In some embodiments, the panel or panels utilized may comprise a variety materials including aluminum, which is particularly suitable because it is relatively lightweight, strong, and malleable. Further still, it is appreciated and understood that panel or panels are capable of being stamped, punched, or otherwise cut into a variety shapes and sizes with a variety of design elements for the desired application. As is evident from the present disclosure, the panel-extrusion construction technique provides sturdy and secure furniture with minimal visible welds and joints. The present disclosure is not limited to the specific furniture embodiments disclosed herein, rather the construction technique can be applied to virtually any piece of furniture conceivable.

While specific embodiments have been described in detail in the foregoing detailed description and illustrated in the accompanying drawings, those with ordinary skill in the art will appreciate that various modification and alternative to those details could be developed in the light of the overall teachings of the disclosure. Accordingly, the particular arrangements disclosed are meant to be illustrative only and not limiting as to the scope of the invention, which is to be given the full breadth of the appended claims and any and all equivalents thereof.

What is claimed is:

1. A chair, comprising:

a frame and a seatback panel;

said frame including a base frame element and an upper frame element, said base frame element delimiting a seat and said upper frame element extending from said base frame and defining armrests and a top rail of said chair;

said seatback panel has a perimeter edge and is disposed between said base frame element and said upper frame element forming side and rear supporting portions of said chair; and wherein:

said frame comprises an extrusion:

defining exterior walls;

defining an insertion channel at one of said exterior walls to define therein an interior, said insertion channel configured to receive at least a portion of said perimeter edge; and including at least one relief channel disposed therethrough; and said seatback panel is welded to said interior of said insertion channel.

2. The chair of claim 1, wherein said insertion channel is wider than a thickness of said perimeter edge of said seatback panel such that a gap is present in said insertion channel when said perimeter edge is inserted therein.

3. The chair of claim 2, wherein said welding is disposed in said gap.

4. The chair of claim 1, wherein said chair is mounted on a swivel base permitting said chair to at least partially rotate about a central axis.

5. The chair of claim 1, wherein said seatback panel is capable of being stamped, cut, punched or perforated.

6. The chair of claim 1, wherein the chair is configured as a lounger.

7. A method of constructing furniture, comprising:

providing at least one frame member with a base frame element and an upper frame element, said base frame element delimiting a seat and said upper frame element extending from said base frame and defining armrests and a top rail;

providing at least one panel between said base frame element and said upper frame element forming side and rear supporting portions, said panel having a perimeter edge, said frame member comprising an extrusion:

defining an exterior including walls;

defining an insertion channel at one of said walls to define therein an interior, said insertion channel configured to receive at least a portion of said perimeter edge of said panel; and including at least one relief channel disposed therethrough; and welding at least a portion of said perimeter edge of said panel to said interior of said insertion channel.

8. The method of claim 7, wherein said insertion channel is wider than a thickness of said perimeter edge such that a gap is present in said insertion channel when said perimeter edge is inserted therein.

9. The method of claim 8, including the step of inserting at least a portion of said perimeter edge of said panel into said insertion channel prior to said welding step.

10. The method of claim 9, wherein said welding step further includes welding said panel to said extrusion inside said insertion channel.

11. The method of claim 7, wherein said panel is capable of being stamped, cut, punched or perforated.

12. The method of claim 7, wherein said frame member is mounted on a swivel base permitted said frame member to at least partially rotate about a central axis.

13. The method of claim 7, wherein the furniture is configured as a chair.

14. The method of claim 7, wherein the furniture is configured as a lounger.

* * * * *